US006733238B2

(12) United States Patent
Hiyama et al.

(10) Patent No.: US 6,733,238 B2
(45) Date of Patent: May 11, 2004

(54) AXIAL-FLOW TURBINE HAVING STEPPED PORTION FORMED IN AXIAL-FLOW TURBINE PASSAGE

(75) Inventors: Takashi Hiyama, Takasago (JP); Eisaku Ito, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 81 days.

(21) Appl. No.: 10/079,853

(22) Filed: Feb. 22, 2002

(65) Prior Publication Data

US 2002/0159886 A1 Oct. 31, 2002

(30) Foreign Application Priority Data

Apr. 27, 2001 (JP) ..... 2001-132962

(51) Int. Cl.[7] ..... F01D 25/30
(52) U.S. Cl. ..... 415/211.2
(58) Field of Search ..... 415/148, 150, 415/207, 208.1, 208.2, 210.1, 211.2

(56) References Cited

U.S. PATENT DOCUMENTS 3,625,630 A * 12/1971 Soo ..... 415/207

FOREIGN PATENT DOCUMENTS

| | | |
|---|---|---|
| CH | 216489 | 8/1941 |
| EP | 1227217 A2 | 7/2002 |
| FR | 996 967 | 12/1951 |
| FR | 1338515 | 9/1963 |
| JP | 5-321896 | 12/1993 |
| JP | 8-260905 | 10/1996 |
| JP | 11-148497 | 6/1999 |

* cited by examiner

*Primary Examiner*—Edward K. Look
*Assistant Examiner*—Dwayne J. White
(74) *Attorney, Agent, or Firm*—Oblon, Spivak, McClelland, Maier & Neustadt P.C.

(57) ABSTRACT

There is provided an axial-flow turbine comprising an exhaust chamber; a turbine including multiple stage rotor blades, said multiple stage rotor blade including terminal stage rotor blades; an annular diffuser located between the turbine and the exhaust chamber; and an annular axial-flow turbine passage defined by the turbine, the diffuser and the exhaust chamber, wherein fluid flows through the axial-flow turbine passage toward the exhaust chamber, and an annular stepped portion which inwardly projects in a radial direction is formed on the portion of an inner wall of the axial-flow turbine passage that is located on the downstream side of a trailing edge of a tip portion of the terminal stage rotor blades provided in the flow direction of the fluid. In the stepped portion, a projecting portion which inwardly projects in a radial direction may be provided.

7 Claims, 7 Drawing Sheets

AXIAL-FLOW TURBINE HAVING STEPPED PORTION FORMED IN AXIAL-FLOW TURBINE PASSAGE

BACKGROUND OF THE INVENTION

1. Field of the Invention

The present invention relates to an axial-flow turbine and, particularly, to a gas turbine in which the pressure between a turbine and a diffuser is locally increased so that the thermal efficiency is increased.

2. Description of the Related Art

In general, it has been required that the temperature in a turbine entrance and pressure ratio are further increased to improve the thermal efficiency of an axial-flow turbine, e.g. gas turbine.

Japanese Unexamined Patent Publications (Kokai) No. 5-321896 and No. 11-148497 disclose a solution in which the shape of the front side or the back side of a blade is modified so that the pressure loss caused by shock waves is decreased. In Kokai No. 5-321896, a blade, for example, a rotor blade in which the shape of the front side or the back side thereof is modified, is disclosed. In Kokai No. 11-148497, a blade, for example, a rotor blade in which the maximum thickness portion of the blade is changed from a position of 40% of a chord length to a position of 60% of the chord length, is disclosed.

However, in the above-described two related arts, only a part of the shape of a blade and, especially, only the shape of the front side or the back side of the blade is taken into account, and the shape of the tip portion of the blade is not taken into account. In general, a space between the tip portion of a blade, especially, a rotor blade and the inner wall of an axial-flow turbine passage e.g. a gas turbine passage, substantially does not exist, and they are located in contact with each other. Therefore, in order to further reduce the pressure loss caused by shock waves to increase the efficiency, not only the shape of the front side or the back side of the blade but also the shape of the tip portion of the blade and the inner wall of the axial-flow turbine passage adjacent to the tip portion should be taken into account.

Accordingly, the object of the present invention is to further reduce the pressure loss, caused by shock waves in the vicinity of a tip portion trailing edge of terminal stage rotor blades, so as to improve the efficiency of the axial-flow turbine by modifying the shape of the tip portion of the blades and the shape of the axial-flow turbine passage e.g. the gas turbine passage.

SUMMARY OF THE INVENTION

According to an embodiment of the present invention, there is provided an axial-flow turbine comprising an exhaust chamber; a turbine including multiple stage rotor blades, said multiple stage rotor blades including terminal stage rotor blades; an annular diffuser located between the turbine and the exhaust chamber; and an annular axial-flow turbine passage defined by the turbine, the diffuser and the exhaust chamber, wherein fluid flows through the axial-flow turbine passage toward the exhaust chamber, and an annular stepped portion which inwardly projects in a radial direction is formed on the portion of an inner wall of the axial-flow turbine passage that is located on the downstream side of a trailing edge of a tip portion of the terminal stage rotor blades provided in the flow direction of the fluid.

In other words, according to the embodiment of the present invention, the streamline of a fluid passing through the axial-flow turbine passage is inwardly curved between the tip portion trailing edge and the upstream end portion of the stepped portion so that variations in the streamline occurs. Therefore, the pressure is increased to reduce the Mach number, and the pressure loss is decreased to improve the turbine efficiency. Additionally, the Mach number is decreased to reduce the occurrence of shock waves and, thus, damage to the tip portion of the rotor blade can be prevented.

These and other objects, features and advantages of the present invention will be more apparent in light of the detailed description of exemplary embodiments thereof as illustrated by the drawings.

BRIEF DESCRIPTION OF THE DRAWING

The present invention will be more clearly understood from the description as set below with reference to the accompanying drawings, wherein.

DESCRIPTION OF THE PREFERRED EMBODIMENTS

Before proceeding to a detailed description of the preferred embodiments, a prior art will be described with reference to the accompanying relating thereto for a clearer understanding of the difference between the prior art and the present invention.

Figure 1:
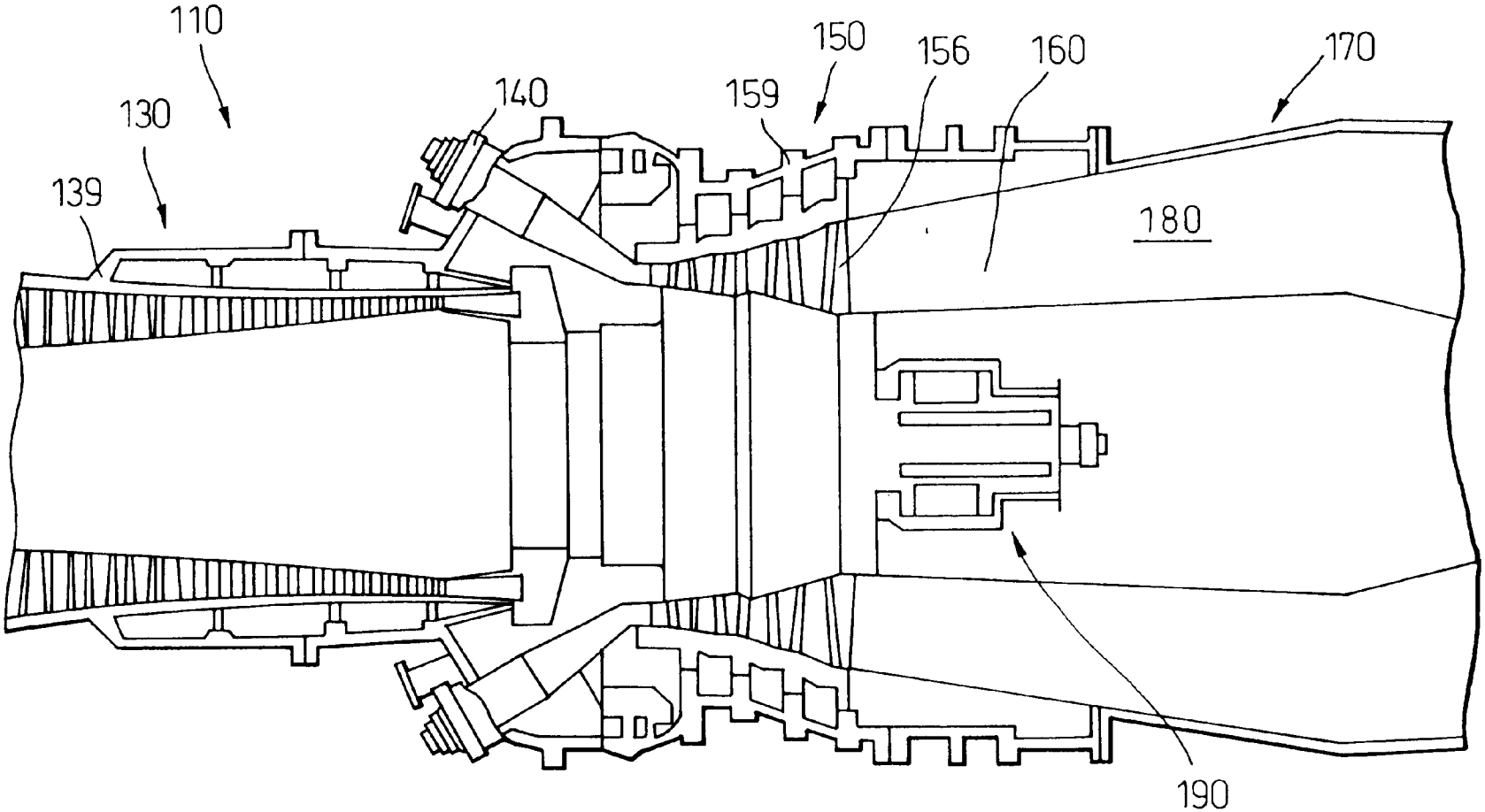
FIG. 1 is a longitudinal partly sectional view of a gas turbine in a related art.

FIG. 1 shows a longitudinal partly sectional view of an axial-flow turbine, e.g. a gas turbine in a related art. An axial-flow turbine, e.g. a gas turbine 110 contains a compressor 130 to compress intaken air, at least one combustor 140 provided on the downstream side of the compressor 130 in the direction of the air flow, a turbine 150 provided on the downstream side of the combustor 140, a diffuser 160 provided on the downstream side of the turbine and an exhaust chamber 170 provided on the downstream side of the diffuser 160. In the axial-flow turbine e.g. the gas turbine 110, the compressor 130, the turbine 150, the diffuser 160 and the exhaust chamber 170 define an annular axial-flow turbine passage e.g. gas turbine passage 180.

The compressor contains, in a compressor casing 139, compressor rotor blades and compressor stay blades composed of multiple-stages. The turbine 150 contains, in the turbine casing 159, rotor blades and stay blades composed of multiple-stages. As shown in the drawing, the compressor 130 and the turbine 150 are provided on a rotating shaft 190. The turbine 150 has the multiple-stage stay blades which is provided on the inner wall of the gas turbine passage 180 and the multiple-stage rotor blades provided on the rotating shaft 190. At each stage of the multiple-stage rotor blades, a plurality of rotor blades are spaced substantially at an equal distance, in the circumferential direction, around the rotating shaft 190.

Fluid, for example, air enters through the inlet (not shown) of the compressor 130 and passes through the compressor 130 to be compressed. The fluid is mixed, in the combustor 140, with the fuel to be burnt, and passes through the turbine 150 provided with multiple-stage blades, for example, four-stage blades. Then, the fluid is discharged through the exhaust chamber 170 via the diffuser 160.

Figure 2:
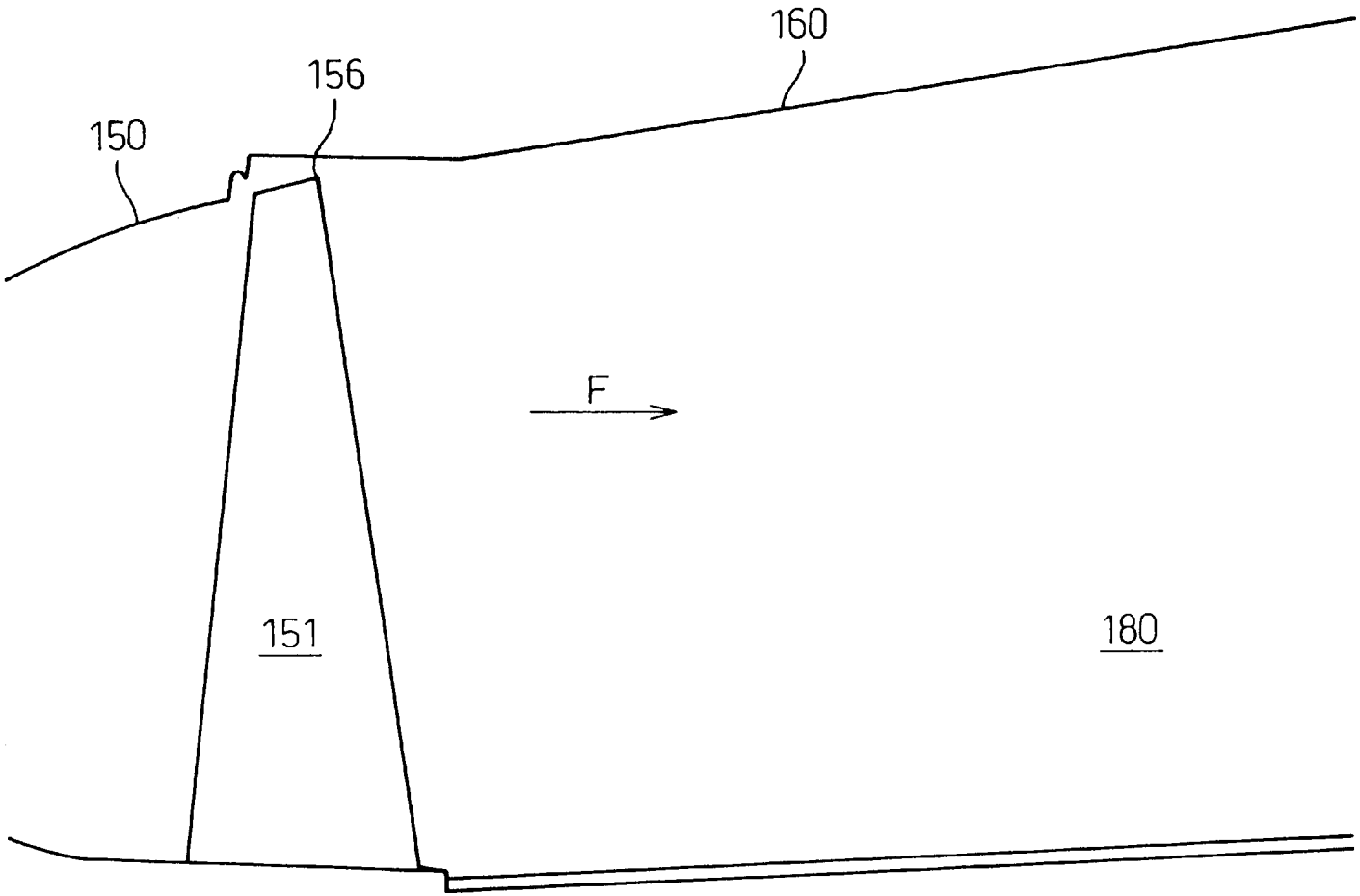
FIG. 2 is an enlarged view of the surroundings of a turbine and a diffuser of a gas turbine in a related art.

FIG. 2 shows an enlarged view of surroundings of the turbine 150 and the diffuser 160 of the gas turbine 110. In FIG. 2, a rotor blade 151 of the terminal stage rotor blades of the turbine 150 is shown. For the purpose of understanding, blades other than the terminal stage rotor blades are omitted. As shown in FIG. 2, the tip portion of the rotor blade 151 substantially linearly extends along the inner wall of the gas turbine passage 180. As shown in FIG. 2, the inner wall of the gas turbine passage 180 in the turbine 150 is formed so that the radius of the inner wall is increased toward the downstream side in the direction of the air flow (indicated by an arrow "F"). Likewise, the inner wall of the gas turbine passage 180 in the diffuser 160 is formed so that the radius of the inner wall is increased toward the downstream side. Therefore, the fluid which passes through the turbine 150 enters into the diffuser 160 while outwardly and radially spreading from the rotating shaft 190.

If the operating temperature and pressure of the gas turbine is enhanced to improve the thermal efficiency, the mechanical load of the turbine itself is increased. In other words, the velocity of the fluid increases and the Mach number increases in the vicinity of the tip portion of the rotor blade 151. Particularly, in the vicinity of the trailing edge of the tip portion 156 of the terminal stage rotor blade 151 as shown in FIG. 2, the Mach number is extremely increased. As a result, pressure loss caused by shock waves tends to increase. Moreover, the tip portion of the rotor blades may be partially broken by the shock wave produced by increasing the Mach number as described above.

Figure 3:
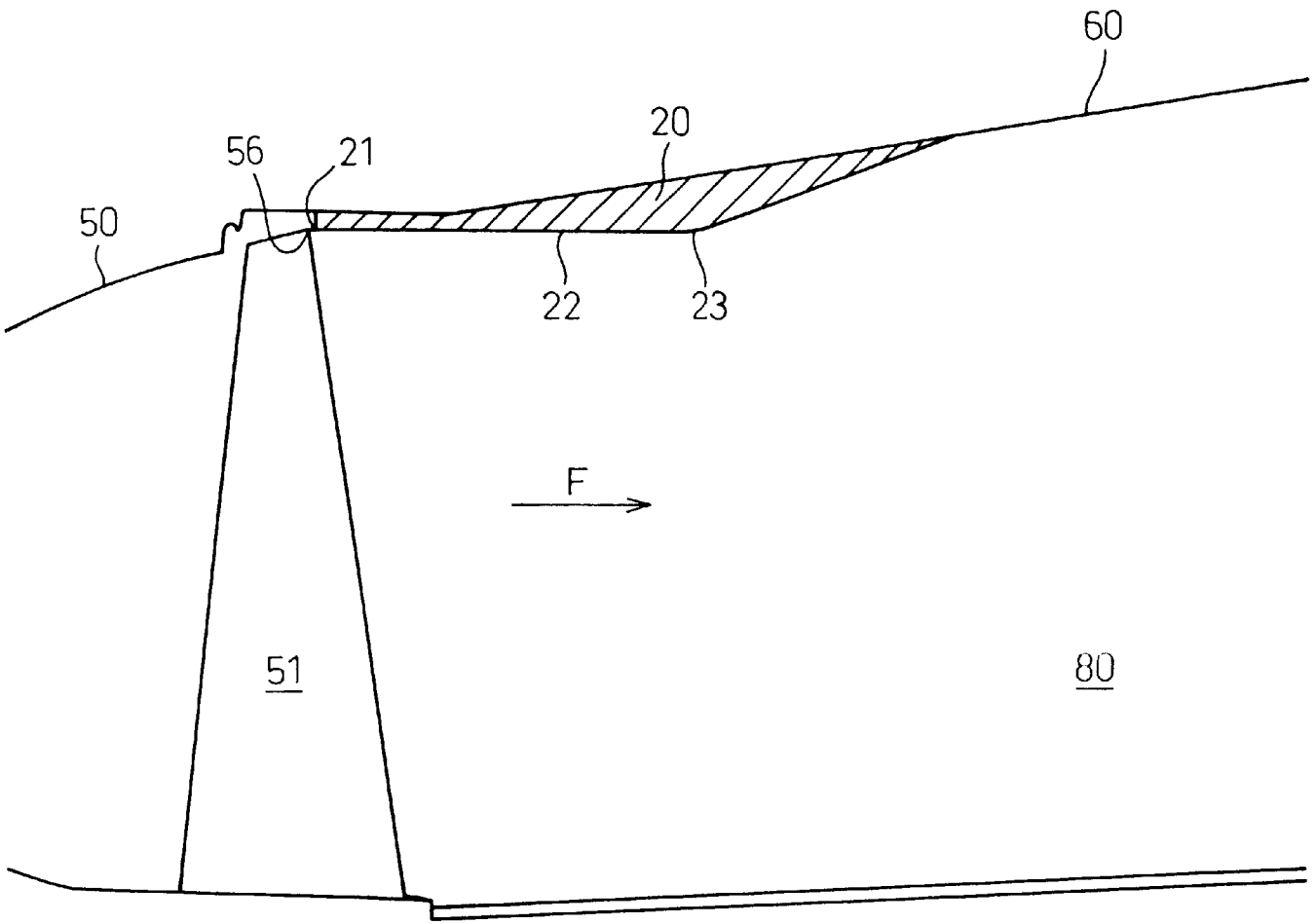
FIG. 3 is a longitudinal partly sectional view of a first embodiment of a gas turbine according to the present invention.

FIG. 3 shows a longitudinal partly sectional view of a first embodiment of the axial-flow turbine, e.g. a gas turbine according to the present invention. As described above, in FIG. 3, the surroundings of a turbine 50 and a diffuser 60 are enlarged. The turbine 50 contains a terminal stage rotor blade 51 of terminal stage rotor blades. For the purpose of understanding, blades other than the terminal stage rotor blade are omitted in the drawing. As shown in FIG. 3, the inner wall of the axial-flow turbine passage e.g. a gas turbine passage 80 in the turbine 50, is formed so that the radius of the inner wall is increased toward the downstream side in the direction of the air flow (indicated by an arrow "F"). The inner wall of the gas turbine passage 80 in the diffuser 60 is formed so that the radius of the inner wall is increased toward the downstream side.

On the inner wall of the gas turbine passage 80 in the diffuser 60, an annular stepped portion 20 is provided on the downstream side of the tip portion leading edge 56 of the rotor blade 51. In the embodiment shown in FIG. 3, the stepped portion 20 inwardly and radially projects from a part of the inner wall of the gas turbine passage 80, which is nearest to the tip portion trailing edge 56 of the rotor blade 51, to the tip portion trailing edge 56. An upstream end portion 21 of the stepped portion 20 and the tip portion trailing edge 56 are not in contact with each other. The stepped portion 20 extends from the upstream end portion 21 of the stepped portion 20 toward the downstream side and the exhaust chamber 70 (not shown) in the gas turbine passage 80 in the diffuser 60. In the first embodiment, the stepped portion 20 has a linear portion 22 extending substantially in parallel with the central axis of a rotating shaft (not shown). If the stepped portion 20 has the linear portion 22, the stepped portion 20 can be easily formed. The stepped portion 20 is slightly outwardly curved at a curved portion 23, and outwardly extends, toward the downstream side, along the inner wall of the gas turbine passage 80 in the diffuser 60.

In other words, in the first embodiment, the distance between the central axis of the rotating shaft and the upstream end portion 21 of the stepped portion 20 is substantially identical to that between the central axis and the tip portion trailing edge 56 of the rotor blade 51. Thus, the stepped portion 20 causes the streamline which represents a flow direction of the fluid to vary so that the streamline is strongly curved between the stepped portion 20 and the tip portion trailing edge 56 and, especially, between the upstream side end portion 21 and the tip portion trailing edge 56. Therefore, the pressure is locally increased at a portion in which the above-described variations in streamline are produced. Consequently, the Mach number is decreased between the stepped portion 20 and the tip portion trailing edge 56 and, especially, between the upstream end portion 21 and the tip portion trailing edge 56, thus resulting in reduction of the pressure loss.

As described above, in the first embodiment, the distance between the central axis and the upstream end portion 21 is substantially identical to that between the central axis and the tip portion trailing edge 56. However, as there is a possibility that variations in streamline may occur even if the distance between the central axis and the upstream end portion 21 is smaller than that between the central axis and the tip portion trailing edge 56, the Mach number can be decreased to reduce the pressure loss. Additionally, as there is a possibility that variations in streamline may occur even if the distance between the central axis and the upstream end portion 21 is larger than that between the central axis and the tip portion trailing edge 56 and is smaller than that between the central axis and the inner wall of the gas turbine passage 80 in the diffuser 60, the Mach number can be decreased to reduce the pressure loss.

Figure 4:
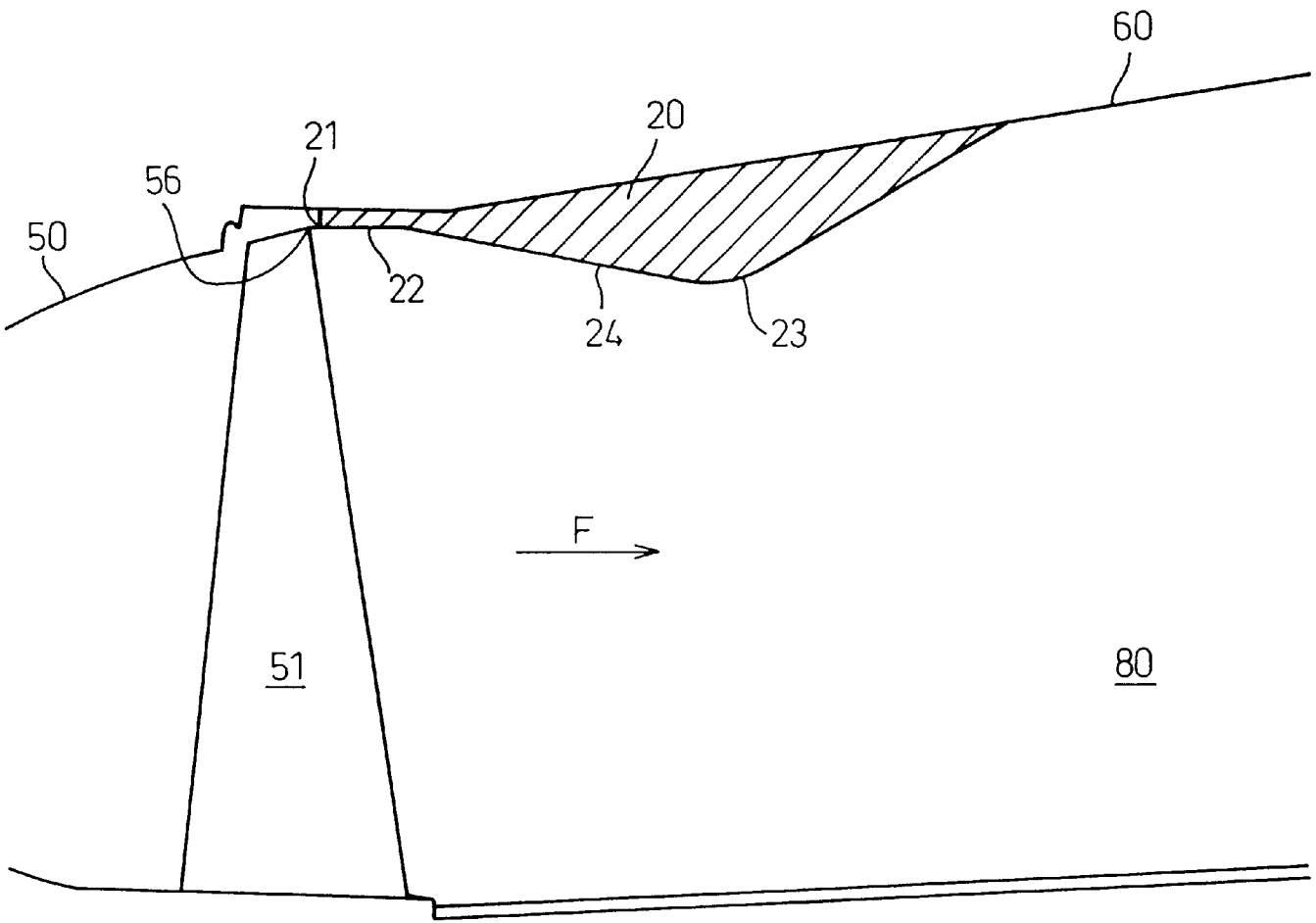
FIG. 4 is a longitudinal partly sectional view of a second embodiment of a gas turbine according to the present invention.

FIG. 4 shows a longitudinal partly sectional view of a second embodiment of an axial-flow turbine, e.g. a gas turbine, according to the present invention. In the stepped portion 20 in the above-described embodiment, a linear portion 22, extending from the upstream end portion 21 substantially in parallel with the central axis, is formed. However, in the second embodiment, the stepped portion 20 has a projecting portion 24 which further projects toward the inside. In other words, in the stepped portion 20, there is a projecting portion in which the distance between the central axis and the upstream end portion 21 is smaller than that between the central axis and the tip portion trailing edge 56. In the second embodiment, the projecting portion 24 exists on the downstream side of the linear portion 22 of the stepped portion 20.

Similar to the first embodiment, the stepped portion 20 causes the streamline which represents the flow direction of the fluid to vary so that the streamline is strongly inwardly curved between the stepped portion 20 and the tip portion trailing edge 56, along the projecting portion 24. Therefore, the pressure is locally increased at a portion in which variations in streamline occurs. Consequently, the Mach number is further decreased between the stepped portion 20 and the tip portion trailing edge 56, thus resulting in a reduction in the pressure loss.

As a matter of course, the projecting portion 24 can be disposed to be adjacent to the upstream end portion 21 without having the linear portion 22 in the second embodiment. In this case, since larger variations in the streamline occur, the pressure loss can be further decreased and the turbine efficiency can be further increased. Similar to the first embodiment, if the distance between the central axis and the upstream end portion 21 is smaller than that between the central axis and the tip portion trailing edge 56, and if the distance between the central axis and the upstream end portion 21 is larger than that between the central axis and the tip portion trailing edge 56 and is smaller than that between the central axis and the inner wall of the diffuser 60, there is a possibility that a variation in streamline may occur. Therefore, the Mach number can be decreased to decrease the pressure loss, and the turbine efficiency can be increased.

Figure 5:
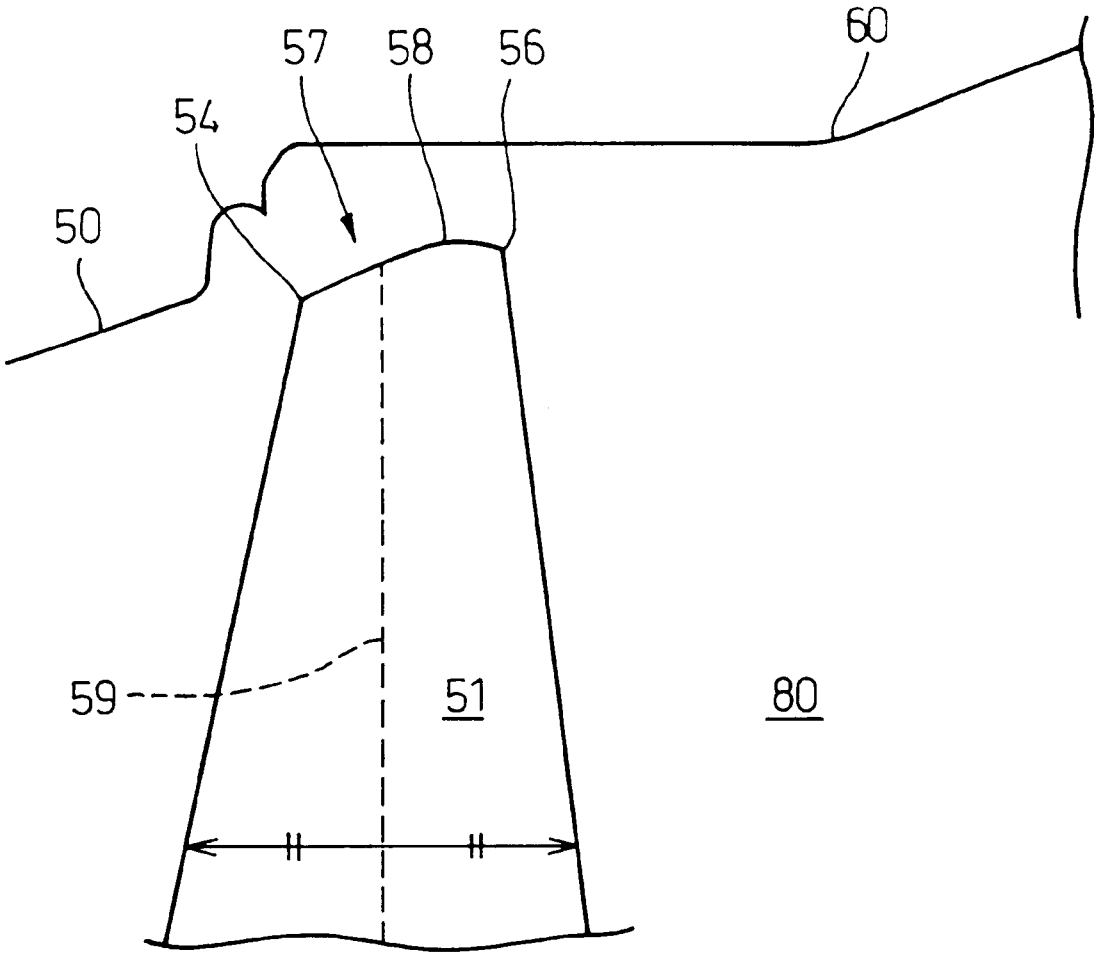
FIG. 5 is an enlarged view of another embodiment of the surroundings of the tip portion of a terminal stage rotor blade of a gas turbine according to the present invention.

FIG. 5 shows an enlarged view of another embodiment of surroundings of the tip portion of a terminal stage rotor blade of an axial-flow turbine, e.g. a gas turbine, according to the present invention. In a related art, a portion between the tip portion leading edge and the tip portion trailing edge of the terminal stage rotor blade 151 substantially linearly extends. However, in this embodiment, a curved portion 57 which is outwardly curved in a radial direction is provided between the tip portion leading edge 54 and the tip portion trailing edge 56 of the terminal stage rotor blade 51.

When fluid is introduced into the axial-flow turbine passage e.g. a gas turbine passage 80, the streamline of the fluid is inwardly curved in a radial direction on the downstream side of the curved portion 57. Therefore, the streamline in the vicinity of the tip portion trailing edge 56 is curved more than that of a related art. Consequently, Mach number is decreased as the pressure is increased, and the pressure loss can be decreased.

In this embodiment, a maximum curvature point 58 in which a curvature of the curved portion 57 reaches maximum is located on the downstream side of an axial direction center line 59 of the terminal stage rotor blade 51 in the flow direction of the fluid. Therefore, the variations in streamline in this embodiment are larger than that in case of the maximum curvature point 58 in the curved portion 57 located on the upstream side of the axial direction center line 59 or located on the axial direction center line 59. Accordingly, in this embodiment, the Mach number can be further decreased and the pressure loss can be further decreased.

As a matter of course, the first embodiment or the second embodiment can be combined with this embodiment, so that the pressure loss can be further decreased to further increase the turbine efficiency. Additionally, the shape of turbine blades and a gas turbine passage in a diffuser can be applied to the shape of a compressor blades and a gas turbine passage in a compressor.

EXAMPLE

Figure 6:
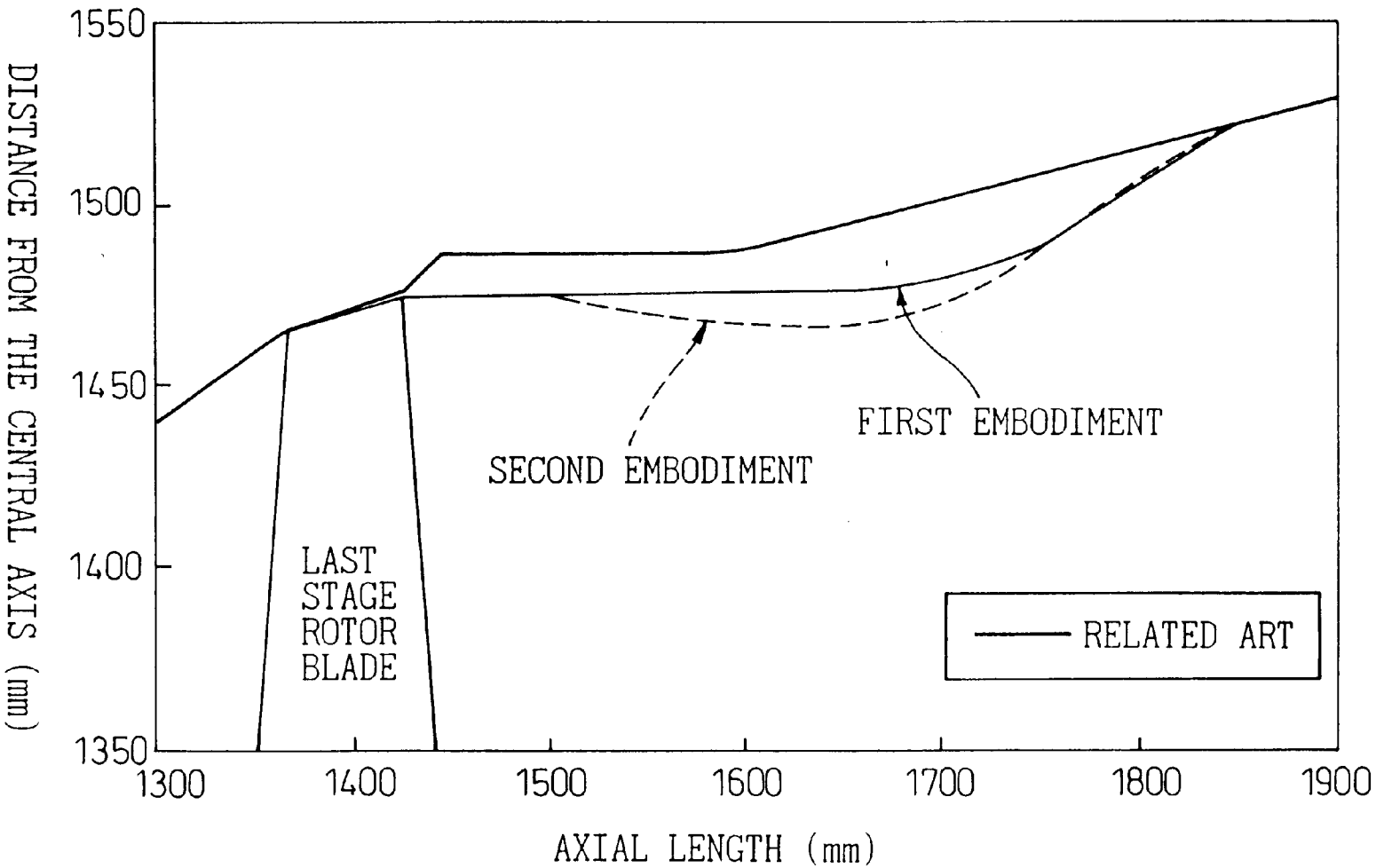
FIG. 6 is a view showing the shape of a gas turbine according to the present invention.

FIG. 6 is a view showing the shape of an axial-flow turbine, e.g. a gas turbine, according to the present invention. In FIG. 6, the horizontal axis represents an axial length of a gas turbine, and the vertical axis represents a distance from the central axis of a rotating shaft. In FIG. 6, the thick line represents a gas turbine in a related art, the thin line represents a gas turbine (having only a linear portion 22) based on the first embodiment, and the dotted line represents a gas turbine (having a projecting portion 24 on the downstream side of the linear portion 22) based on the second embodiment, respectively.

Figure 7:
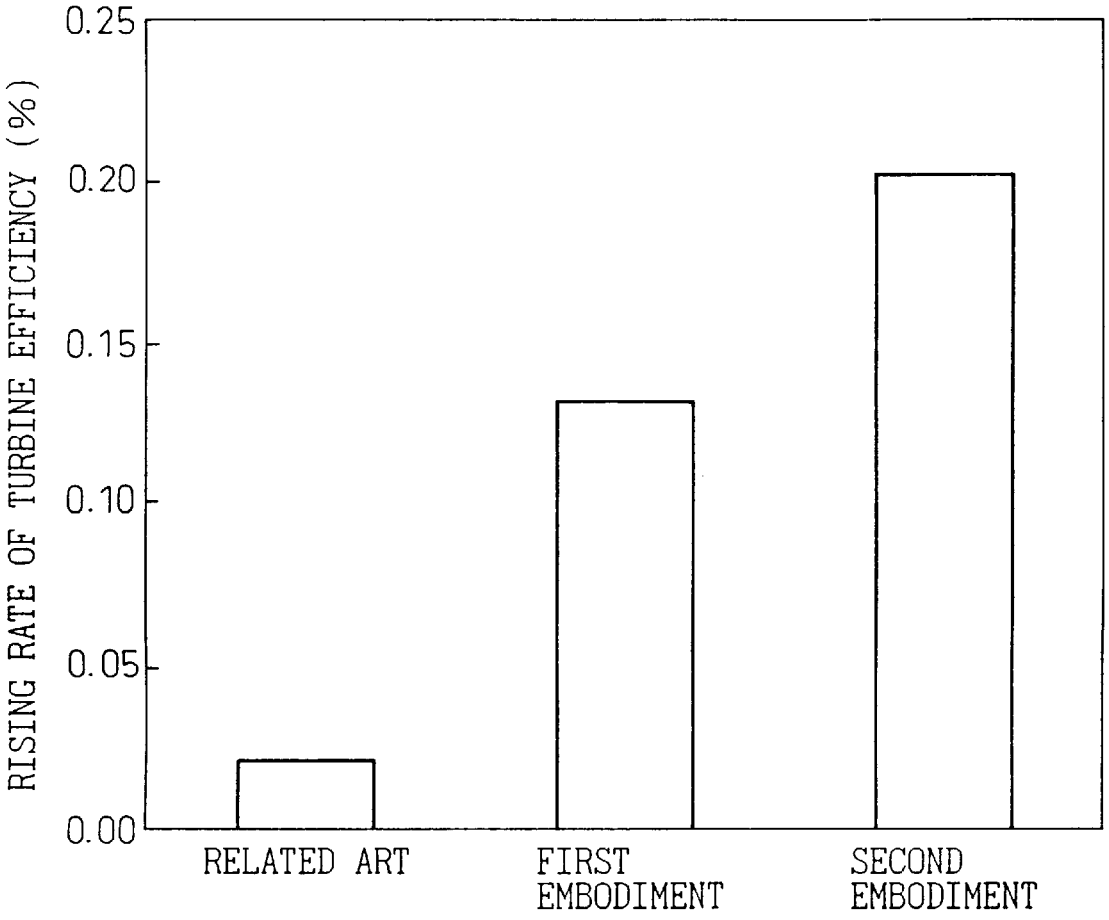
FIG. 7 is a view showing the rising rate of the turbine efficiency of a gas turbine.

FIG. 7 shows the rising rate of turbine efficiency of an axial-flow turbine, e.g. a gas turbine, for each of these embodiments. According to the present invention, the gas turbine efficiency can be improved by 0.13% in the first embodiment, and by 0.20% in the second embodiment.

Further, it will be apparent to those skilled in the art that the present invention can be applied to steam turbines.

According to the present invention, there can be obtained common effects in which the streamline of the fluid which flows through an axial-flow turbine passage e.g. a gas turbine passage, is curved so that the Mach number can be decreased to decrease the pressure loss, and the turbine efficiency can be increased. Additionally, there can be obtained common effects in which the Mach number is decreased to decrease the shock waves so that damage to the tip portions of rotor blades can be decreased.

Moreover, according to the present invention, there can be obtained effects in which the shape of a stepped portion is modified to further curve the streamline of the fluid so that the pressure loss can be further decreased and the turbine efficiency can be further increased.

Moreover, according to the present invention, can be obtained effects in which the streamline that passes between the upstream end portion and the tip portion trailing edge is curved along the projecting portion so that the Mach number and the pressure loss can be decreased to increase the turbine efficiency.

Moreover, according to the present invention, there can be obtained effects in which the streamline of the fluid is inwardly curved, in a radial direction, on the downstream side of the tip portion trailing edges of the terminal stage rotor blades so that the pressure loss can be decreased and the turbine efficiency can be increased.

Although the invention has been shown and described with exemplary embodiments thereof, it will be understood by those skilled in the art that various changes, omissions and additions may be made therein and thereto without departing from the spirit and the scope of the invention.

What is claimed is:

1. An axial-flow turbine comprising an exhaust chamber;

a turbine including multiple stage rotor blades, said multiple stage rotor blades including terminal stage rotor blades, an annular diffuser located between the turbine and the exhaust chamber; and an annular axial-flow turbine passage defined by the turbine, the diffuser and the exhaust chamber, wherein fluid flows through the axial-flow turbine passage toward the exhaust chamber, and an annular stepped portion which inwardly projects in a radial direction is formed on the portion of an inner wall of the axial-flow turbine passage that is located on the downstream side of a trailing edge of a tip portion of the terminal stage rotor blades provided in the flow direction of the fluid, and the distance between the central axis of the turbine and the stepped portion is substantially identical to that between the central axis of the turbine and the tip portion trailing edge of the terminal stage rotor blades.

2. An axial-flow turbine according to claim 1, wherein the upstream end portion of the stepped portion located on the upstream side in the flow direction of the fluid is located at the inner wall of the axial-flow turbine adjacent to the tip portion trailing edge of the terminal stage rotor blades.

3. An axial-flow turbine according to claim 1 or 2, wherein the stepped portion has a linear portion which extends from the upstream end portion of the stepped portion located on the upstream side in the flow direction of the fluid, substantially in parallel with the central axis of the turbine.

4. An axial-flow turbine according to claim 1 or 2, wherein the stepped portion has a projecting portion which radially projects from the inner wall of the axial-flow turbine more inwardly than the tip portion trailing edge of the terminal stage rotor blades.

5. An axial-flow turbine according to claim 4, wherein the projecting portion is disposed downstream of the linear portion.

6. An axial-flow turbine according to claim 1 or 2, wherein the terminal stage rotor blades have a curved portion which is radially and outwardly curved between a tip portion leading edge and the tip portion trailing edge of the terminal stage rotor blades.

7. An axial-flow turbine according to claim 6, wherein the maximum curvature point of the curved portion is located on the downstream side of a center line of the terminal stage rotor blades in the axial direction in the flow direction of the fluid.

* * * * *